US006685176B2

(12) United States Patent
Wirth, Jr. et al.

(10) Patent No.: US 6,685,176 B2
(45) Date of Patent: Feb. 3, 2004

(54) CLAMP PAD AND BAR CLAMP ASSEMBLY

(75) Inventors: John Wirth, Jr., Dubois, WY (US); Paul Brutsman, Casper, WY (US); Dan Stoops, Casper, WY (US); Jay L. Sanger, Casper, WY (US); Mark K. McCool, Casper, WY (US)

(73) Assignee: Woodworker's Supply, Inc., Casper, WY (US)

( * ) Notice: Subject to any disclaimer, the term of this patent is extended or adjusted under 35 U.S.C. 154(b) by 110 days.

(21) Appl. No.: 09/982,894

(22) Filed: Oct. 18, 2001

(65) Prior Publication Data

US 2003/0075850 A1 Apr. 24, 2003

(51) Int. Cl.[7] ..... B25B 1/24

(52) U.S. Cl. ..... 269/6; 269/147; 269/283; 269/284

(58) Field of Search ..... 269/147, 6, 283, 269/284, 280, 279, 282, 208, 171.5, 166, 246

(56) References Cited

U.S. PATENT DOCUMENTS 1,781,997 A * 11/1930 Berezowski ..... 269/280
2,653,499 A * 9/1953 Partiss ..... 269/280
3,499,206 A * 3/1970 Quernheim ..... 269/283
3,767,183 A * 10/1973 Van Gelder ..... 269/283
5,002,264 A * 3/1991 Nimtz ..... 269/283
5,988,616 A 11/1999 Fuller et al.
6,039,313 A 3/2000 Baculy
6,302,386 B1 * 10/2001 Fuller et al. ..... 269/6

* cited by examiner

*Primary Examiner*—Robert C. Watson
(74) *Attorney, Agent, or Firm*—Nixon & Vanderhye PC

(57) ABSTRACT

A clamp pad is provided for being selectively mounted to each jaw of a bar clamp assembly. The clamp pad can be easily mounted to the clamp jaw and radially locked in place with respect to the bar clamp assembly. In an embodiment of the invention, the clamp pad is configured to selectively be fit on either of the clamp jaws of the bar clamp assembly to facilitate assembly. The clamp pad defines a substantially increased clamping area to evenly distribute force and prevent damage to the associated workpiece. The increased dimensions of the clamp pad also stabilizes the bar clamp assembly, which eliminates tipping and thus eliminates the need for associated assemblies such as clamp saddles and the like.

21 Claims, 8 Drawing Sheets

CLAMP PAD AND BAR CLAMP ASSEMBLY

BACKGROUND OF THE INVENTION

The present invention relates to clamp assemblies and, more particularly, to a novel clamp pad for being provided in association with a bar clamp for increasing the clamping area and for elevating and supporting the bar clamp with respect to a work surface.

Conventional bar clamp assemblies generally include an elongated pipe or rod, hereinafter collectively referred to as a bar, and a pair of opposing clamp jaws. The jaws of conventional bar clamp assemblies define parallel, opposed workpiece engaging surfaces. At least one of the clamp jaws is slidably disposed on the bar and selectively fixed in place at a desired position on the bar. A clamping actuator is further provided to linearly advance the other jaw towards and away from the one jaw, to selectively apply and release pressure to workpiece(s) disposed between the clamp jaws. Such bar clamp assemblies are conventionally used for holding a workpiece during operations such as cutting, drilling, nailing, screwing, gluing, and similar such manipulative procedures where the workpiece must be held steady or two or more workpieces held in predetermined relative positions.

When a bar clamp is used to clamp a workpiece, it is generally preferred to provide a protective layer between the face of the clamp jaw and the workpiece surface, to prevent damage or abrasion to the clamped workpiece by the jaws of the clamp, which are typically cast from steel. For this purpose, often a piece of scrap wood, or other relatively soft material, is interposed between the clamping jaw and the workpiece. Sometimes, clamp pads are disposed over the clamp jaws.

SUMMARY OF THE INVENTION

While the above-described conventional approaches provide some protection against damage, such as abrasion, it is often difficult to assuredly maintain the scrap material or conventional clamp pads in proper position to avoid damage to the workpiece and to securely clamp the workpiece(s). It would therefore be desirable to provide a clamping pad assembly which can be easily and assuredly mounted to a bar clamp assembly so as to be held and maintained in proper position relative to the clamp bar and the associated workpiece.

It would further be desirable to provide a clamp pad that provides additional advantageous functions such as to elevate the bar clamp assembly above a work surface to provide greater versatility in its clamping and supporting function.

The present invention provides a clamp pad for being selectively mounted to each jaw of a clamp assembly, such as a bar clamp assembly, that can be easily mounted to the clamp jaw and secured in place with respect to the bar clamp assembly. In an embodiment of the invention, the clamp pad is configured to selectively be fit on either of the clamp jaws of a bar clamp assembly to facilitate assembly of the clamp pads to the clamp. The clamp pad of the invention defines an increased clamping area to evenly distribute force and prevent damage to the associated workpiece. The increased dimensions of the clamp pad stabilizes and supports the bar clamp assembly, which eliminates tipping of the clamp and thus will also eliminate the need for associated assemblies such as clamp saddles and the like. Moreover, the ample size of the pad advantageously stabilizes the clamp on its side and allows clearance for the handle. Indeed, a significant advantage of the clamp pad of the invention is that it allows the clamp to be used on its side and top.

In accordance with one aspect of the invention there is provided a clamping system for clamping workpieces that includes an elongated bar and first and second clamp jaws mounted to the bar, one of the jaws being selectively displaceable along the length of the bar and selectively locked in position on the bar and the other of the clamp jaws being selectively actuated to be displaced towards and away from the one jaw to lock at least one workpiece therebetween; and at least one clamp pad, each clamp pad being mounted to a respective clamp jaw, each said clamp pad comprising a front face for engaging a workpiece; a rear face spaced from the front face; a clamp jaw receptacle defined between said front and rear faces of said clamp pad, said the receptacle having an open bottom; a first cutout being defined in said front face to straddle said bar and a second cutout defined in said rear face to straddle a portion of the clamp jaw; and at least one locking component for selectively vertically locking said clamp pad to said bar.

In accordance with another aspect of the invention there is provided a A clamping system for clamping workpieces that includes: an elongated bar and first and second clamp jaws mounted to the bar, one of the jaws being selectively displaceable along the length of the bar and selectively locked in position on the bar and the other of the clamp jaws being selectively activated to be displaced towards and away from the one jaw to lock at least one workpiece therebetween; and at least one clamp pad, each clamp pad being slideably mounted to a respective clamp jaw, each said clamp pad comprising: a first, front face for engaging a workpiece, a second, rear face spaced from said first face, a clamp jaw receptacle defined between said first and second faces, said receptacle having an open bottom end, and means for radially locking said clamp pad to said bar. In an exemplary embodiment, the means for radially locking said clamp pad to said bar comprises a cutout defined in said clamp pad for receiving the bar and a locking component for locking said bar in said cutout.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
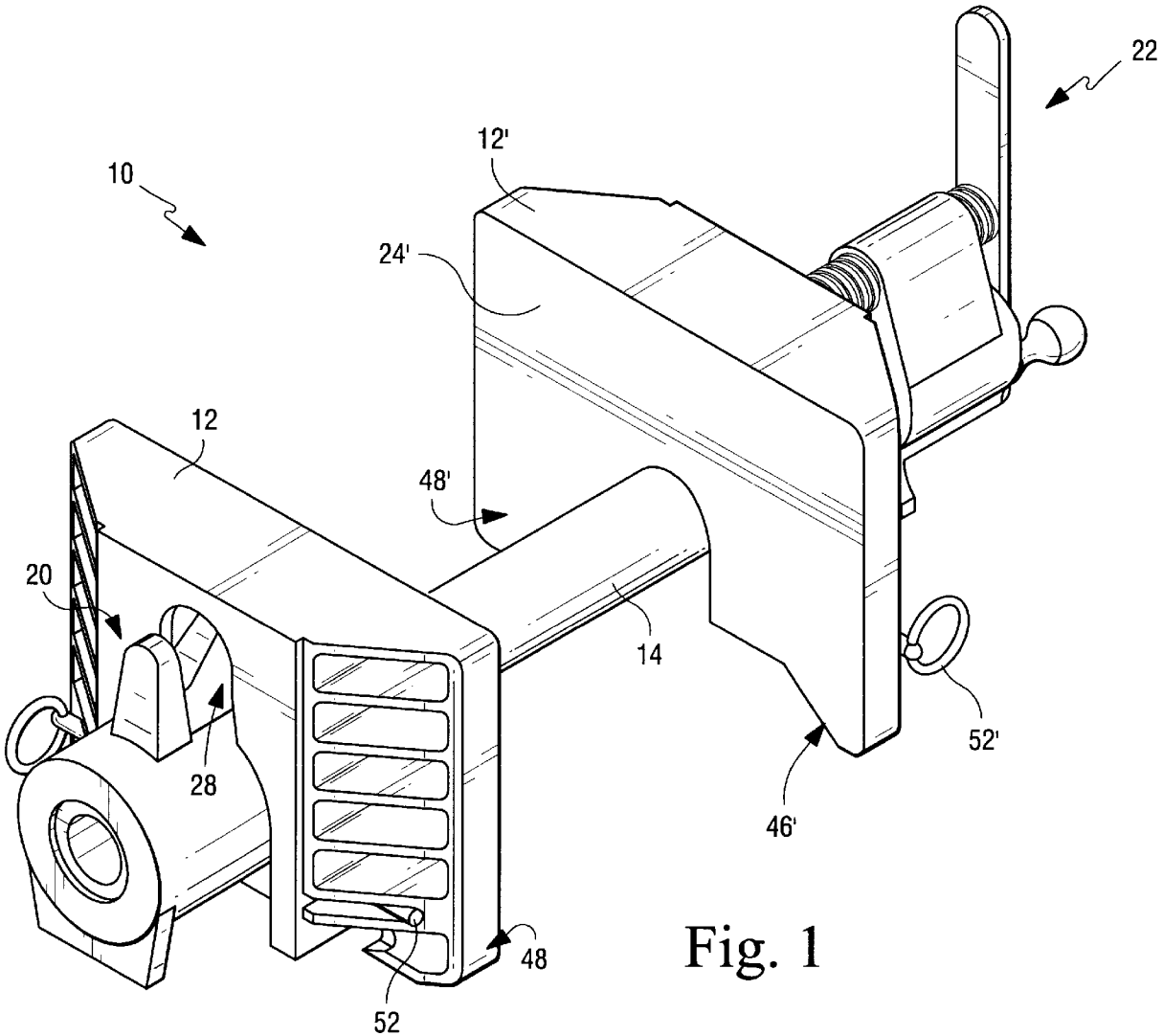
FIG. 1 is a schematic perspective view illustrating first and second clamp pads embodying the invention mounted to a bar clamp assembly.
Figure 2:
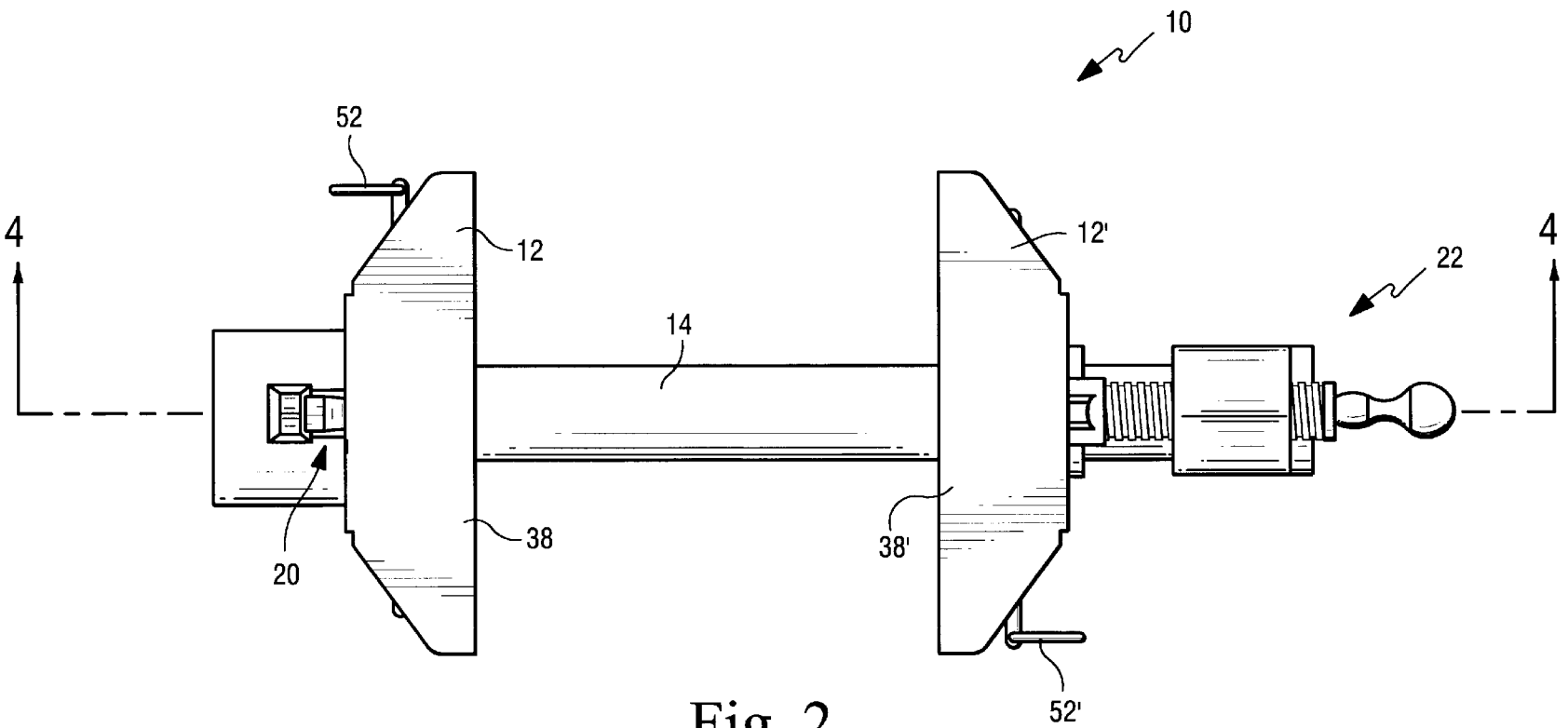
FIG. 2 is a top plan view of the assembly of FIG. 1.

A bar clamp assembly 10 having clamp pads 12 embodying the invention mounted thereto is schematically shown in the illustrations of FIGS. 1–4. Since two identical clamp pads are shown in FIGS. 1–4, the reference numerals used to label one of the clamp pads are primed but will not be independently discussed hereinbelow. The illustrated bar clamp assembly 10 is composed of an elongated pipe or rod, hereinafter generically characterized as a bar 14 and first and second clamp jaws 16,18 which are each slidably disposed on the bar. The bar which may be solid but is more preferably hollow, as in the illustrated embodiment, to reduce the weight thereof. Further, the bar is preferably made of metal according to strength considerations. In the illustrated embodiment, the bar is circular in cross-section, but other cross-sectional configurations may be adopted, if desired.

One of the jaws 16 includes a locking mechanism, as schematically shown at 20. The locking mechanism is adapted to hold the jaw in a conventional manner at a selected position on the bar 14. Details of the locking mechanism are omitted as conventional. A linear actuator 22 is operatively coupled to the other jaw 18 for selectively linearly advancing jaw 18 towards and away from jaw 16 to selectively apply pressure to the one or more workpieces interposed between the jaws. The bar clamp assembly schematically illustrated in FIG. 1 is known as a pony bar clamp. However, as will be understood from the disclosure hereinbelow, the invention is not limited to particulars of the illustrated bar clamp assembly.

In an embodiment of the invention, a clamp pad 12 is detachably secured to each of the jaws 16,18 of the bar clamp assembly, and more specifically detachably secured to the bar 14 of the bar clamp assembly at a respective jaw. Each of the clamp pads 12 includes a first generally smooth front face 24 for engaging and clamping workpiece(s) disposed between the clamping jaws, and a second, rear face 26 spaced from the front face. In the illustrated embodiment, the front and rear faces are both planar and are disposed in parallel. A receptacle or pocket 28 is defined between the wall structures 30,32 defining the front and rear faces, for snuggly accommodating the vertical flange portion of a respective jaw, as described in greater detail below.

A first cutout 34 is defined in the front face 24 and wall structure 30 for straddling the bar 14 of the bar clamp assembly and a second cutout 36 is defined in the rear face 26 and wall structure 32 for accommodating the locking mechanism 20 or actuator 22, depending on the clamp jaw 16,18 to which the clamp pad is mounted.

Figure 3:
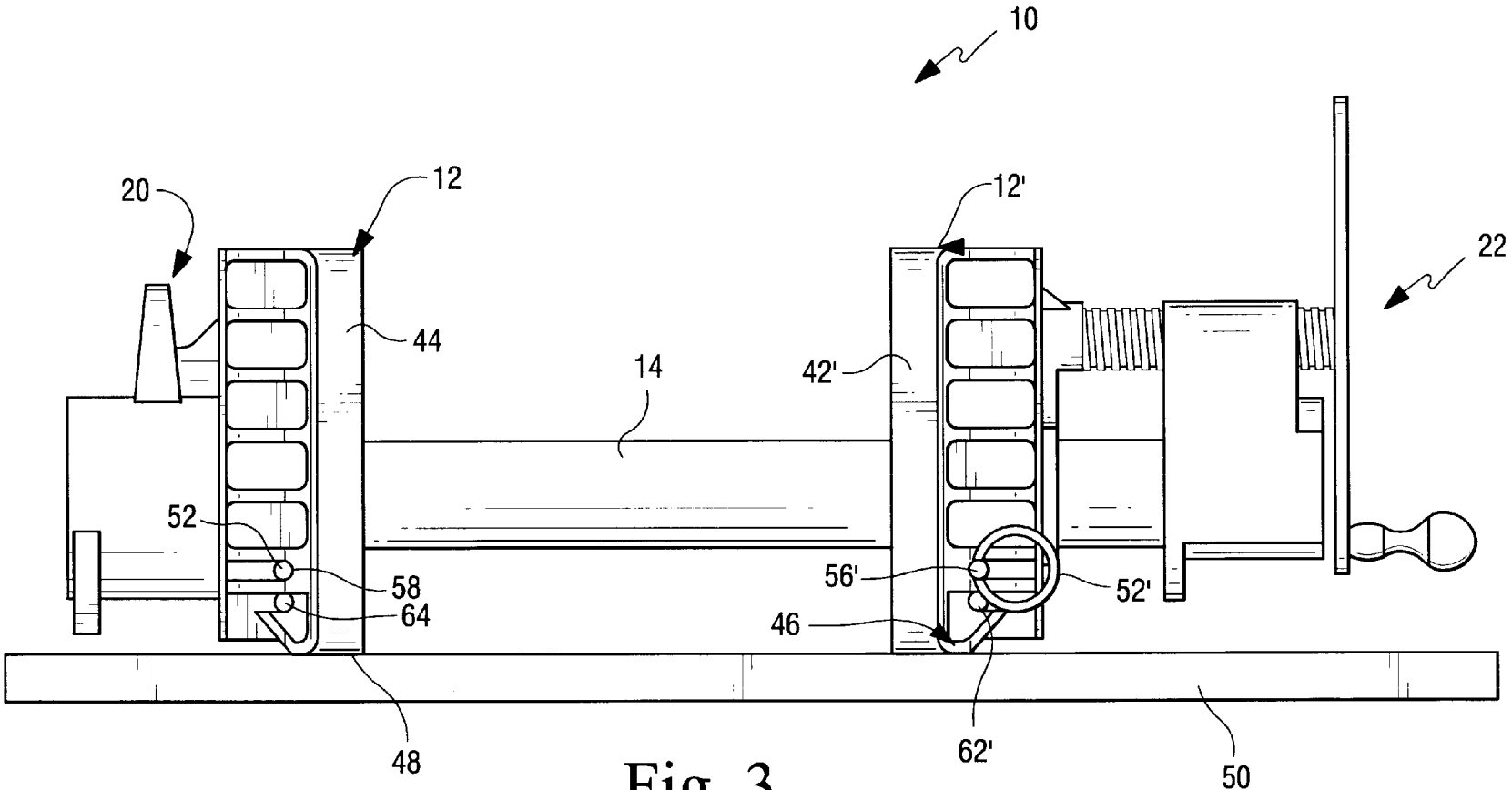
FIG. 3 is a side elevational view of the assembly of FIG. 1.
Figure 4:
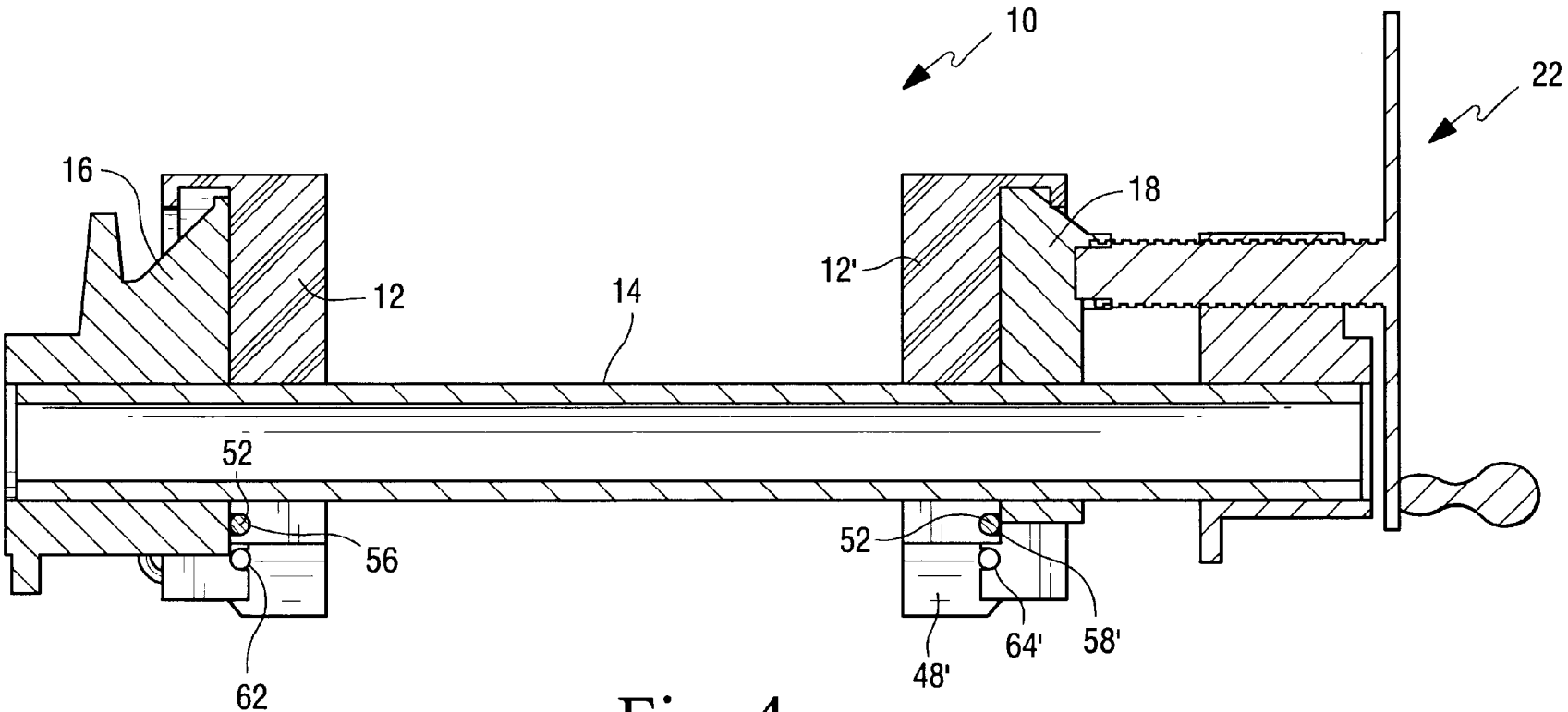
FIG. 4 is a schematic cross sectional view taken along line 4—4 of FIG. 2.

As illustrated, the clamp pad 12 is of general rectangular configuration defining a top surface 38, a bottom surface 40, and first and second side surfaces 42,44. The clamp pad 12 is adapted to be mounted to the respective clamp jaw 16,18 from above. Thus, the cutouts 34,36 are defined to extend from the bottom surface 40 of the clamp pad, more specifically, the bottom edge of the front and rear faces 24,26, respectively. An evident advantage of the clamp pads of the invention is that they can be configured to provide a workpiece engaging front face 24 which is substantially larger than the workpiece engaging surface defined by the vertical flanges of the conventional clamp jaws 16,18 of the clamp assembly. In the illustrated embodiment, the clamp pad is further configured to define first and second feet 46,48. As best illustrated in FIGS. 1 and 3, the feet elevate and support the bar clamp assembly 10 above the work surface 50. The feet enable the pads to act as stabilizers to avoid tipping of the clamps and also to eliminate the need for clamp saddles.

As noted above, each clamp pad 12 has a receptacle or pocket 28 defined therewithin for snuggly accommodating the vertical flange portion of a respective jaw. Advantageously, the pocket 28 is configured to substantially limit or preclude movement of the clamp pad 14 in a vertical direction, parallel to the axis of the bar 14, while allowing movement in a direction radial to the bar axis for the clamp pad to be mounted to and removed from the clamp jaw.

Figure 5:
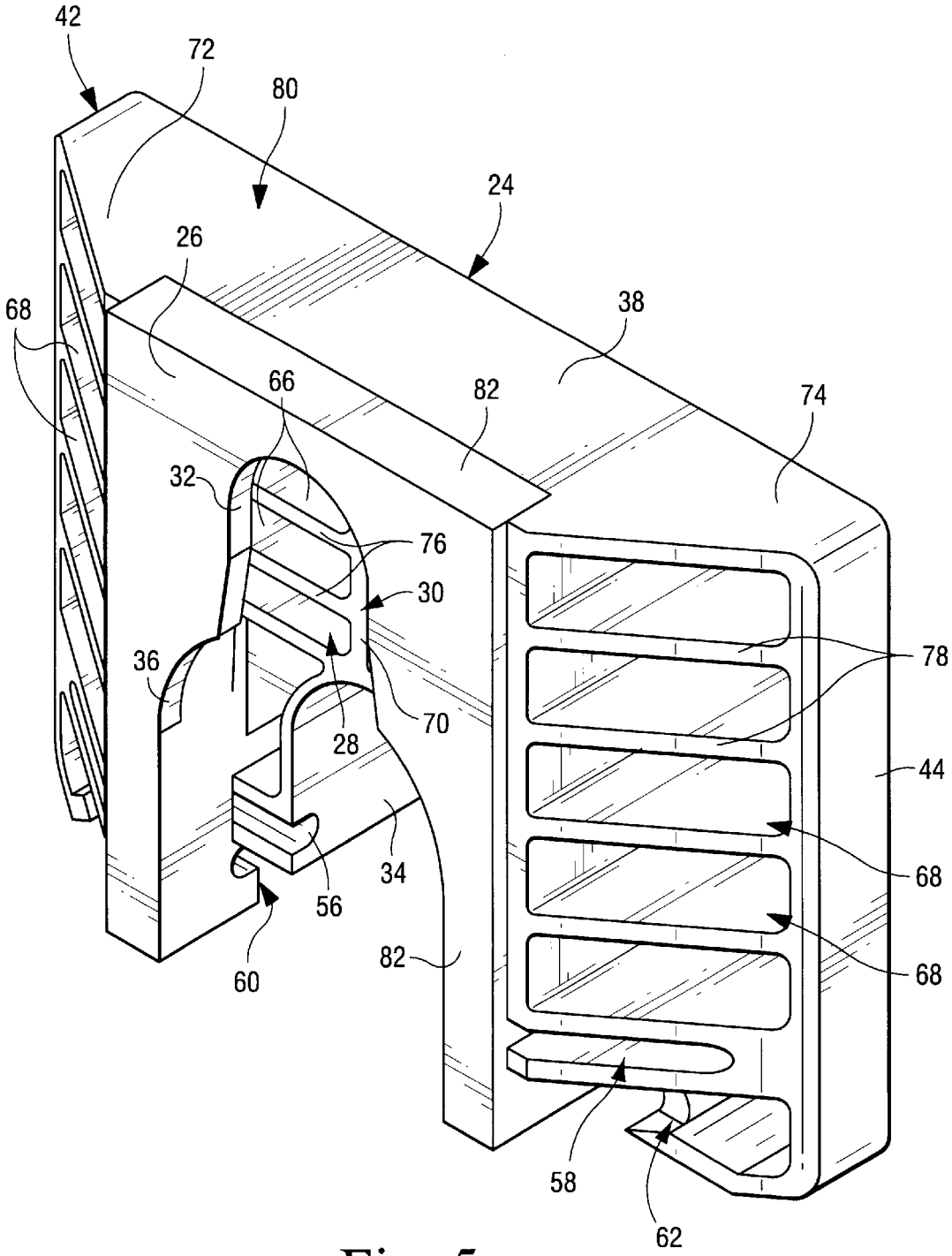
FIG. 5 is a perspective view of a clamp pad embodying the invention.
Figure 6:
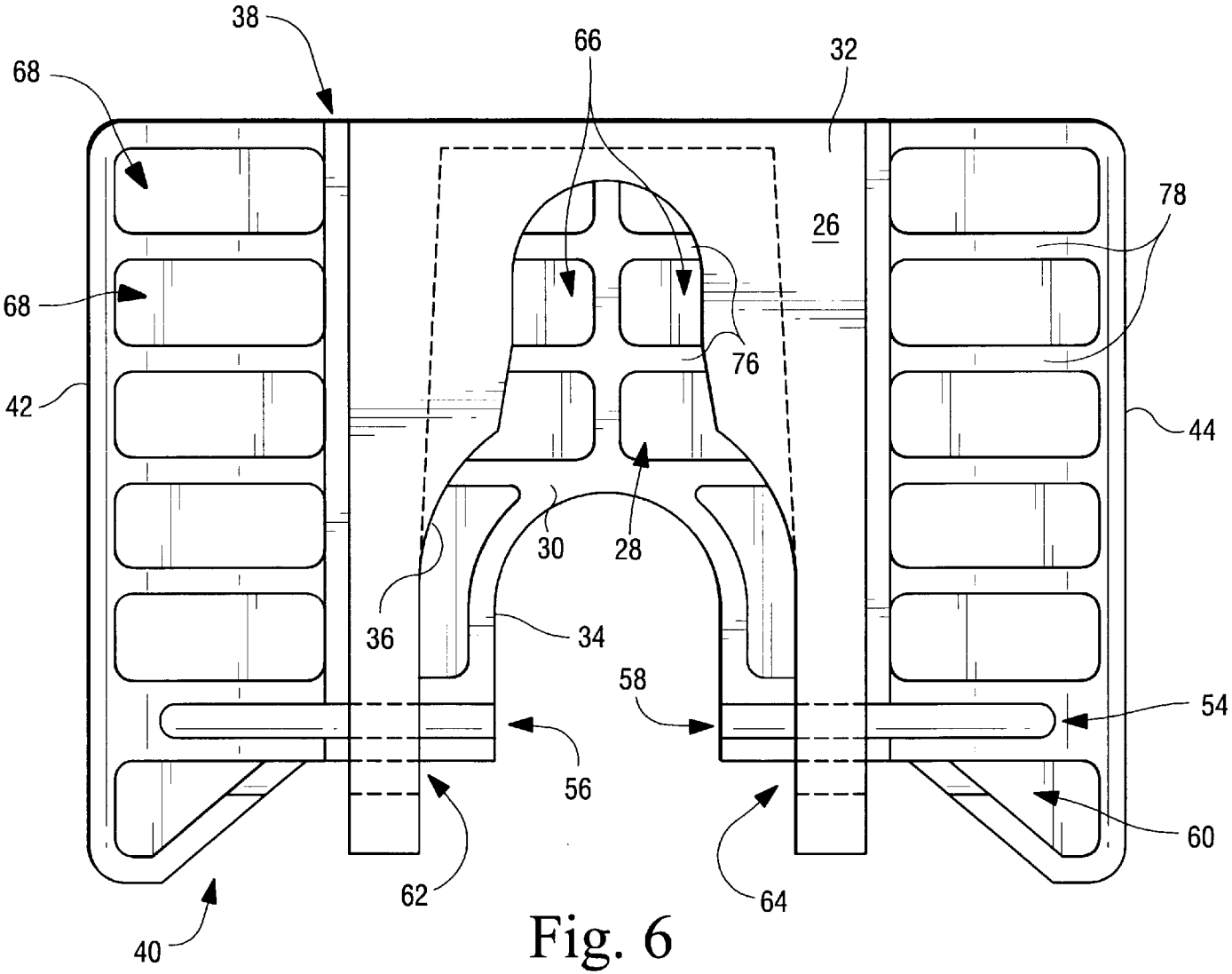
FIG. 6 is a rear end elevational view of the clamp pad of FIG. 5 showing the clamp jaw receptacle.
Figure 7:
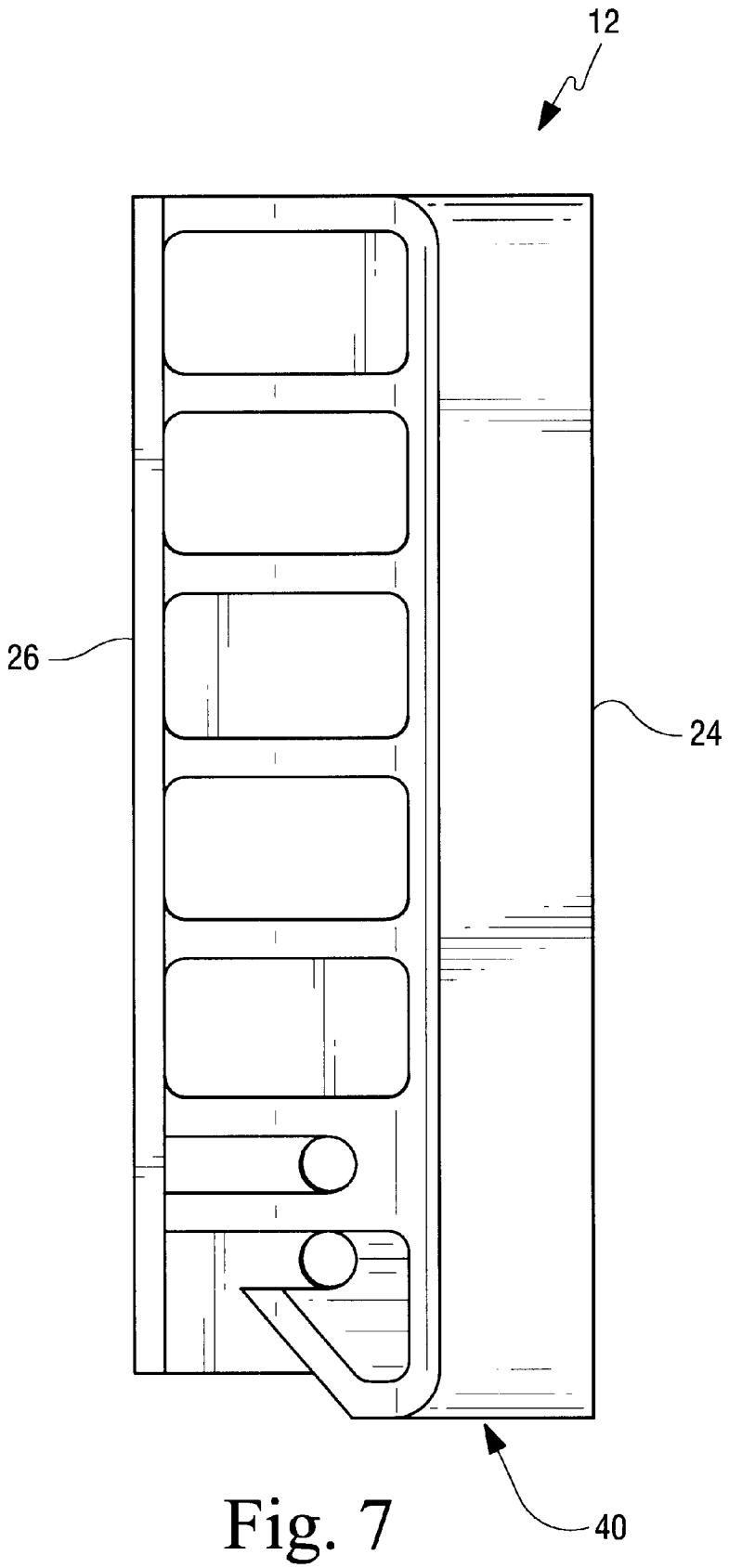
FIG. 7 is a side elevational view of the clamp pad of FIG. 5.
Figure 8:
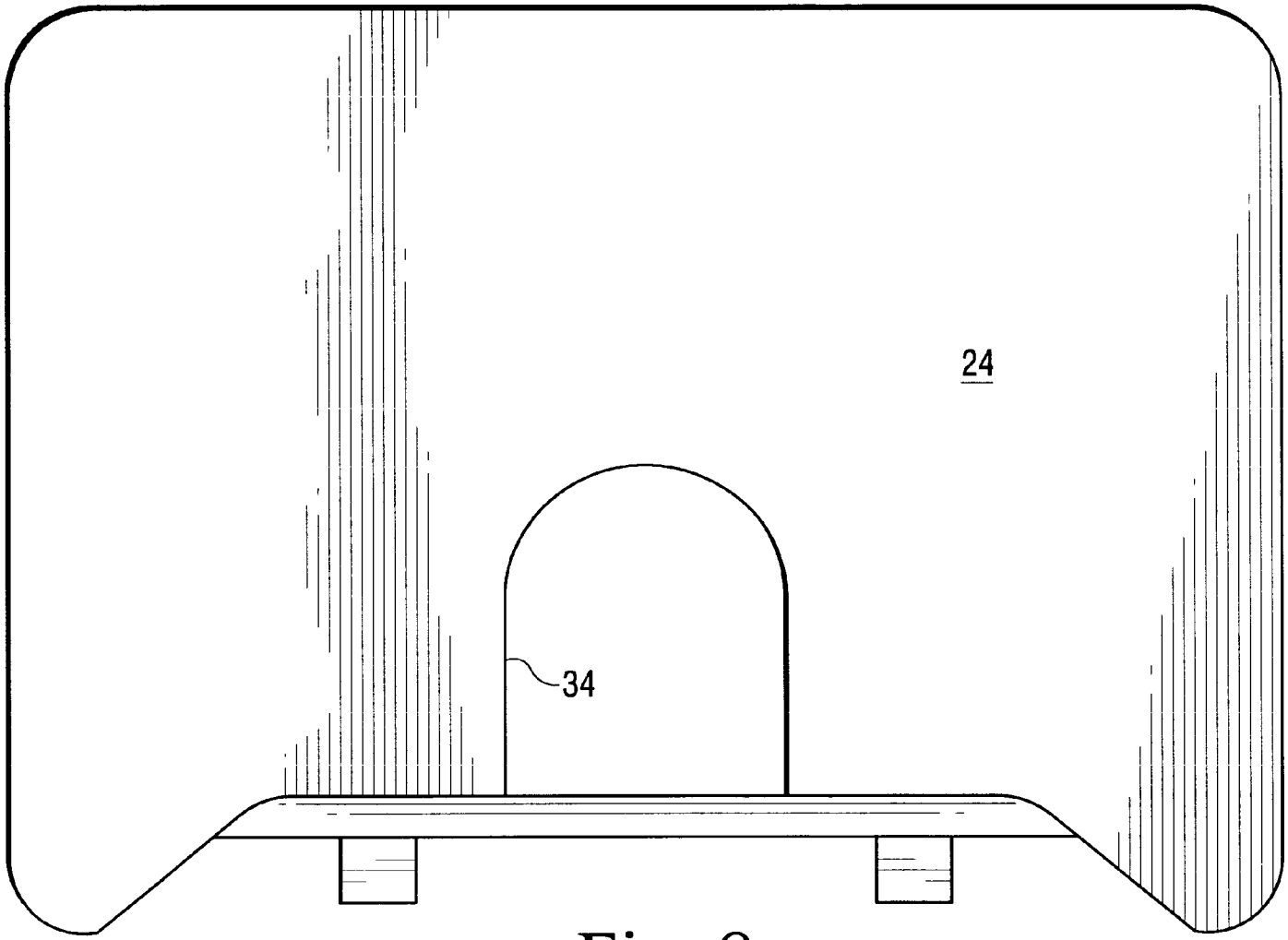
FIG. 8 is a front end elevational view of a clamp pad embodying the invention, showing the workpiece engaging front surface thereof.

As illustrated in FIGS. 1, 6 and 8, in particular, at least one locking component 52 is provided for selectively vertically locking the clamp pad 14 to the bar clamp assembly with the respective clamp jaw received in the receptacle. In the illustrated and presently preferred embodiment, the locking component is a locking pin 52 which is slidably disposed in a transverse bore defined through select portions of the clamp pad. In a preferred embodiment, as shown, e.g., in FIGS. 5 and 7, first and second locking pin receiving bores 54,60 are defined through the clamp pad transversely to the axis of the bar and each is defined by first and second bore portions 56,58; 62,64 on opposing sides of the second cutout 36. FIG. 1 illustrates the locking pin 52 disposed through the first bore 54. In the alternative the locking pin 52 may be disposed through the second, vertically lower bore 60, as illustrated in FIG. 7 without the locking pin and in FIG. 8 with the locking pin 52. Providing two bore locations for the locking pin component allows for the clamp pads to fit a variety of clamp assemblies having bars and clamp jaws of varying sizes and configurations. As an alternative to providing two bore locations, an indexable block having one or more off-center locking pin bores can be disposed in the clamp pad cutout for receiving a locking pin inserted through aligned pin bore portions of the clamp pad. Because the block's locking pin bore is off-center, the orientation of the block when the locking pin is inserted will determine the space remaining in the cutout for receiving the clamp bar. As will be understood, providing an indexable block as described will also allow the clamp pad to fit a variety of clamp assemblies having pipes or bars and clamp jaws of varying sizes and configurations.

Although a locking pin has been illustrated and is currently a preferred locking component for the clamp pad of the invention, it is to be understood that the invention is not limited to the illustrated locking pin. Indeed, as an alternative, instead of a separate locking pin component, plastic fingers may be provided to hold the pad to the clamp bar. In that case, the user would simply dispose the clamp pad over the clamp jaw and then strike or otherwise apply a force to the top of the pad to snap it onto the clamp assembly. Such locking fingers would effectively retain the clamp pad on the clamp assembly as desired. Other types of connectors which facilitate quick connection of the clamp pad to the clamp jaw and quick detachment thereof when desired may also be used instead of the illustrated cutouts and locking pins. As a further alternative, the pad could be designed to slip over the bar in order to secure the pad to the clamp bar. This could be accomplished by forming a bore in the clamp pad to slideably receive the clamp bar. This would require one to disassemble the clamp, slide the pad over the respective clamp jaw, and slide the clamp pad, together with the respective clamp jaw, onto the clamp bar. In this way the clamp pad would be vertically locked to the clamp bar, but without a separate locking component. A locking component, such as a locking pin as illustrated are preferred, however, as they facilitate assembly and removal and also accommodate a variety of bar clamp assemblies by virtue of the two locking positions provided. Additional locking positions may also be provided by defining additional locking pin bores.

Although not illustrated in particular, a grip and/or cushion pad may be adhesively secured or over molded to the workpiece engaging front face of the clamp pad to further protect the workpiece(s) they engage. Examples of surface coverings and pads which may be molded to or attached to the wall include Formica, wood veneer, rubber, cork, felt, a low-E over molded plastic, and other types of materials which enhance gripping of the workpiece and/or cushioning of the workpiece.

As can be seen in FIGS. 1 and 5–7, a plurality of recesses 66,68 are defined at regular intervals in the clamp pad, both in the wall structure 30 defining one surface 70 of the clamp jaw receptacle, and in the peripheral portions 72,74 of the clamp pad. The purpose of these recesses 66,68 is to enable the clamp pad to be molded from plastic to a thickness and transverse dimension suitable for attachment to the bar clamp assembly and to provide an interface with the workpiece, while being reinforced against distortion, and without unduly increasing the weight of the clamp pad. Thus, the recesses 66,68 limit the weight of the molded article while the ribs 76,78 defined between the recesses resist deflection of wall 30. To facilitate molding, the clamp pad is preferably formed in two parts, one part 80 defining a main portion of the clamp pad, including the wall 30 defining the front face 24 and the one surface 70 of the clamping jaw receptacle 28 as well as the peripheral portions 72,74 of the clamp pad and the second part 82 including the wall 32 defining the rear face 26 and the remainder of the clamping jaw receptacle. Although the clamp pad has been described in particular as molded from plastic, it is to be understood that the clamp pad of the invention can, in the alternative, be made from machined plastic, or cast metal.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A clamping assembly comprising:

a bar clamp including an elongated bar and first and second opposed clamp jaws;

a first clamp pad for being releasably mounted to one of said clamp jaws, and a locking component for selectively locking the clamp pad directly to the elongated bar so as to limit movement of said clamp pad in a direction radial to the bar.

2. A clamping assembly as in claim 1, wherein the clamp pad includes a first workpiece engaging surface and a second surface spaced from said first surface, and defines a clamp jaw receiving receptacle between said first and second surfaces.

3. A clamping assembly as in claim 2, wherein a cutout is defined in said clamp pad for straddling a bar of the bar clamp assembly.

4. A clamping assembly as in claim 3, wherein said cutout has a length greater than a transverse dimension of said bar, so that when said clamp pad straddles said bar, said clamp pad extends beyond said bar on each lateral side thereof to define first and second feet for supporting said bar with respect to a work surface.

5. A clamping assembly as in claim 3, wherein said cutout is defined through said first face of the clamp pad.

6. A clamping assembly as in claim 1, wherein said locking component comprises a locking pin for being received in a locking pin bore.

7. A clamping assembly as in claim 6, wherein there are first and second locking pin bores for selectively receiving said locking pin.

8. A clamping assembly as in claim 6, wherein said locking pin bore is defined in said clamp pad.

9. A clamping assembly as in claim 6, wherein said locking pin bore extends in a direction transverse to an axis of said bar.

10. A clamping assembly as in claim 1, wherein the clamp pad is formed from plastic material.

11. A clamping system for clamping workpieces that includes:

an elongated bar and first and second clamp jaws mounted to the bar, one of the jaws being selectively displaceable along the length of the bar and selectively locked in position on the bar and the other of the clamp jaws being selectively activated to be displaced towards and away from the one jaw to lock at least one workpiece therebetween; and at least one clamp pad, each clamp pad being mounted to a respective clamp jaw, each said clamp pad comprising:

a first, front face for engaging a workpiece, a second, rear face spaced from said first face, a clamp jaw receptacle defined between said first and second faces, said receptacle having an open bottom end, a first cutout defined in said first face to straddle said bar, and at least one locking component for selectively locking said clamp pad to said bar so as to limit radial displacement of said clamp pad with respect to said bar.

12. A clamping system as in claim 11, wherein a second cutout is defined in said second face to straddle a portion of the respective clamp jaw.

13. A clamping system as in claim 11, wherein said first cutout has a vertical dimension greater than a transverse dimension of said bar, so that when said clamp pad straddles said bar, said clamp pad extends beyond said bar on each lateral side thereof to define first and second feet for supporting said bar with respect to a work surface.

14. A clamping system as in claim 11, wherein said locking component comprises a locking pin for being received in a locking pin bore.

15. A clamping system as in claim 14, wherein there are first and second locking pin bores for selectively receiving said locking pin.

16. A clamping system as in claim 14, wherein said locking pin bore is defined in said clamp pad.

17. A clamping system as in claim 14, wherein said locking pin bore extends in a direction transverse to an axis of said bar.

18. A clamping system as in claim 11, wherein the clamp pad is formed from plastic material.

19. A clamping pad system for clamping working that includes:

an elongated bar and first and second clamp jaws mounted to the bar, one of the jaws being selectively displaceable along the length of the bar and selectively locked in position on the bar and the other of the clamp jaws being selectively activated to be displaced towards and away from the one jaw to lock at least one workpiece therebetween; and at least one clamp pad, each clamp pad being slideably mounted to a respective clamp jaw, each said clamp pad comprising:

a first, front face for engaging a workpiece, a second, rear face spaced from said first face, a clamp jaw receptacle defined between said first and second faces, said receptacle having an open bottom end, and means for locking said clamp pad to said bar so as to limit radial displacement of said clamp pad with respect to said bar.

20. A clamping system as in claim 19, wherein said means for radially locking said clamp pad to said bar comprises a cutout defined in said clamp pad for receiving said bar.

21. A clamping system as in claim 20, wherein said cutout has an open bottom and wherein said means for radially locking said clamp pad to said bar further comprises a locking component for locking said bar in said cutout.

* * * * *